US005924496A

United States Patent [19]

Buchanan et al.

[11] Patent Number: 5,924,496

[45] Date of Patent: Jul. 20, 1999

[54] VARIABLE BLADE PITCH ADJUSTMENT MECHANISM

[75] Inventors: Brian C. Buchanan; Paul J. Staebler, Jr., both of Clayton, N.C.

[73] Assignee: Caterpillar Inc., Peoria, Ill.

[21] Appl. No.: 09/022,968

[22] Filed: Feb. 12, 1998

[51] Int. Cl.[6] ..... E02F 3/76

[52] U.S. Cl. ..... 172/824; 172/818

[58] Field of Search ..... 172/818, 824, 172/811, 826, 823; 37/266

[56] References Cited

U.S. PATENT DOCUMENTS

| | | | |
|---|---|---|---|
| 2,565,337 | 8/1951 | Allan | 172/818 X |
| 2,600,244 | 6/1952 | Harper | 172/818 X |
| 2,837,845 | 6/1958 | Armington | 172/824 |
| 2,974,430 | 3/1961 | Bernotas | 172/824 |
| 5,507,352 | 4/1996 | Frisbee et al. | 172/818 |

*Primary Examiner*—Christopher J. Novosad
*Attorney, Agent, or Firm*—Diana L. Charlton

[57] ABSTRACT

Top link assemblies for a construction machine are typically used to adjust the pitch angle of a cutting edge of a blade. The present top link assembly has an elongated member and a block member connected to the blade and a frame, respectively, of the machine. The elongated member has upper and lower surfaces defined on a body portion and a pair of spaced openings therethrough. The block member has a lower surface substantially coplanar with the lower surface of the elongated member and a pair of spaced threaded openings therein substantially coaxial with the pair of openings in the elongated member. A pair of spacers having notched end portions are disposed in a stacked relationship on the upper surface of the elongated member. A pair of threaded bolts extend through the notched end portions of the spacers and the openings in the elongated member for threading into the block member, to secure the top link assembly at a first predetermined length. The desired pitch angle of the cutting edge may be adjusted by loosening the threaded bolts and repositioning any one of the spacers between the lower surfaces of the elongated and block members to secure the top link assembly at a second predetermined length. The ability to adjust the pitch angle without removing the top link assembly increases productivity and decreases costs.

8 Claims, 6 Drawing Sheets

VARIABLE BLADE PITCH ADJUSTMENT MECHANISM

TECHNICAL FIELD

This invention relates generally to a top link assembly for use on a blade assembly of a construction machine and more particularly to the adjustability of the cutting angle of the blade assembly through the use of the top link assembly.

BACKGROUND ART

Present top link assemblies for connecting a blade assembly to a frame of a construction machine require a joint assembly which is flexible to achieve the desired range of motion for the blade assembly and a linkage which can be adjusted to vary the pitch of the blade assembly for a multitude of cutting angle positions.

Most top link assemblies currently have flexible joint assemblies and adjustable linkages. The adjustable linkages which are utilized, however, generally require that the entire linkage be disassembled with various components either being replaced, removed or reinstalled after the adjustment to the cutting angle has been made. Additionally, during this adjustment process, shims and other devices may be used to attain the desired pitch of the cutting angle. The disassembly of the linkage for each pitch adjustment of the blade assembly cutting angle limits productivity and increases costs. Furthermore, even when utilizing a linkage which can be adjusted without complex disassembly, the tooling and adjustment components may be cumbersome and difficult to use.

The present invention is directed to overcoming the problems as set forth above.

DISCLOSURE OF THE INVENTION

In one aspect of the present invention, an adjustable top link assembly is disclosed for connecting a blade assembly to a frame. An elongated member is connected by a first joint assembly to the blade assembly. The elongated member has a body portion with upper and lower planar surfaces which define a pair of openings therethrough. A block member is connected by a second joint assembly to the frame. The block member has a lower planar surface adjacent and substantially co-planar with the lower surface of the body portion of the elongated member with a defined pair of threaded openings extending a predetermined distance therein. The pair of threaded openings in the block member are substantially co-axial with the pair of openings in the elongated member. A pair of fastener mechanisms extend simultaneously through the openings in the elongated member and are threaded into the block member to secure the elongated member and block member together to define a first predetermined length of the top link assembly. At least one spacer is secured by the pair of fastener mechanisms at a first position in the top link assembly for maintaining the first predetermined length thereof and is secured at a second position in the top link assembly for defining a second predetermined length thereof.

In another aspect of the present invention, an adjustable top link assembly is disclosed for connecting a blade assembly to a frame. An elongated member is connected by a first joint assembly to the blade assembly. The elongated member has a body portion with upper and lower planar surfaces which define a pair of openings therethrough. A block member is connected by a second joint assembly to the frame. The block member has a lower planar surface adjacent and substantially co-planar with the lower surface of the body portion of the elongated member with a defined pair of threaded openings extending a predetermined distance therein. The pair of threaded openings in the block member are substantially co-axial with the pair of openings in the elongated member. A pair of fastener mechanisms extend simultaneously through the openings in the elongated member and are threaded into the block member to secure the elongated member and block member together to define a first predetermined length of the top link assembly. Means are included for adjusting the length of the top link assembly without removal of the pair of fastener mechanisms.

In yet another aspect of the present invention, a method is disclosed for adjusting the pitch angle of a blade assembly for a construction machine having a frame. The method includes the steps of connecting a elongated member through a first joint assembly to the blade assembly. The elongated member has a body portion with upper and lower planar surfaces defining a pair of openings therethrough. Then, connecting a block member through a second joint assembly to the frame. The block member has a lower planar surface and defines a pair of threaded openings which extend a predetermined distance therein from the lower planar surface. Next, positioning the lower planar surface of the block member adjacent the lower planar surface the elongated member and substantially co-planar therewith so that the respective pair of openings are substantially co-axially aligned. Then, extending a threaded fastener through each of the openings in the elongated member for threading into the block member to secure the elongated member and block member together to define a top link assembly with a first predetermined length. Next, loosening the threaded fasteners within a predetermined number of rotations to position at least one spacer having a pair of semi-arcuate notched portions between the elongated member and block member of the top link assembly by sliding the semi-arcuate notched end portions thereof about the threaded fasteners. Finally, tightening the threaded fasteners to secure the elongated member, block member and at least one spacer together to define a second predetermined length of the top link assembly.

The present invention utilizes a pair of fastener mechanisms to secure a pair of members together on a top link assembly to define a first predetermined length. Additionally, the present invention includes the ability to move at least one spacer from a first position for maintaining the first predetermined length and a second position to define a second predetermined length without removal of the fastener mechanisms. These features provide a method of adjusting the pitch angle of a blade assembly for a construction machine without disassembling the entire top link assembly with simple adjustment components that are readily accessible when needed. The ability to adjust the pitch angle in such a manner increases productivity and decreases associated labor costs.

BEST MODE FOR CARRYING OUT THE INVENTION

Figure 1:
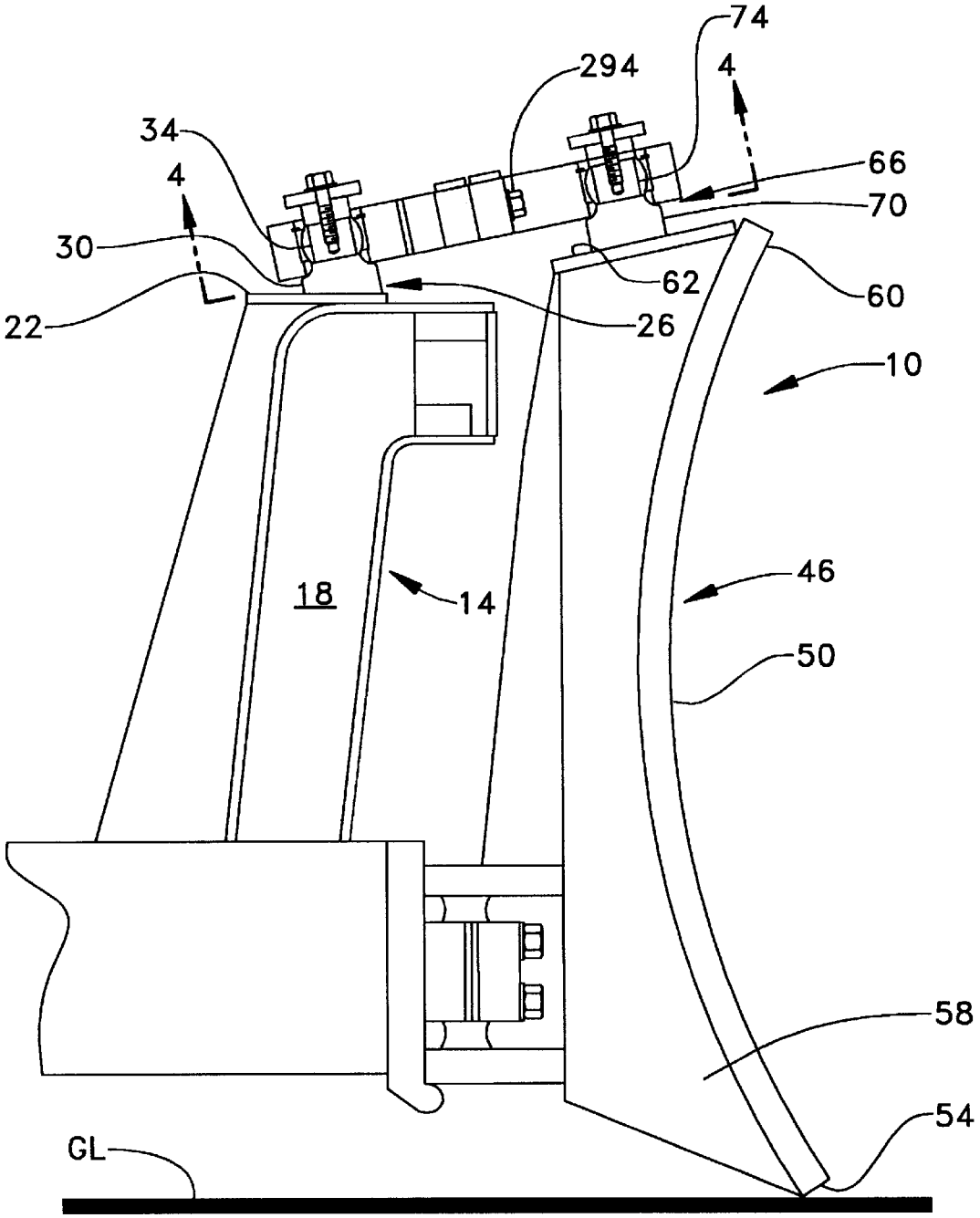
FIG. 1 is a partial side view of a frame tower assembly and blade assembly for a construction machine embodying a connection therebetween by the present invention.

A construction machine 10 with a frame assembly 14 is partially shown in FIG. 1. The frame assembly 14 includes a frame tower 18 connected at a front portion of the frame assembly 14. The frame tower 18 extends upwardly from the frame assembly 14 a predetermined distance and includes an uppermost planar surface 22. A frame tower pin 26 is attached at a base portion 30 in a well know manner, such as welding, to the uppermost planar surface 22 and extends therefrom a predetermined distance and terminates at a solid pin portion 34. The solid pin portion 34 defines a threaded bore 38 therein which extends a predetermined distance downwardly from an upper surface 42.

A blade assembly 46 is releasable connected to the frame assembly 14 in a well known manner, such as through a pivot. The blade assembly 46 has a blade portion 50 with a cutting edge 54 positioned at a lower portion 58 thereof and an upper portion 60. The blade assembly 46 has an upper planar surface 62 which is positioned at a greater height from a ground location GL than the uppermost planar surface 22 of the frame tower 18. It should be understood, however, that the upper planar surface 62 may be located at a lower height from the ground location GL than the uppermost planar surface 22 of the frame tower 18. The upper planar surface 62 of the blade assembly 46 is disposed at an angle relative to the uppermost planar surface 22 of the frame tower 18. It should be understood, however, that no angle is necessary to achieve the desired result. A blade pin 66 is attached at a base portion 70 in a well know manner, such as welding, to the upper planar surface 62 and extends therefrom a predetermined distance and terminates at a solid pin portion 74. The blade pin 66 is positioned at a predetermined distance away from the pivot. The solid pin portion 74 defines a threaded bore 78 therein which extends a predetermined distance downwardly from an upper surface 82.

Figure 2A:
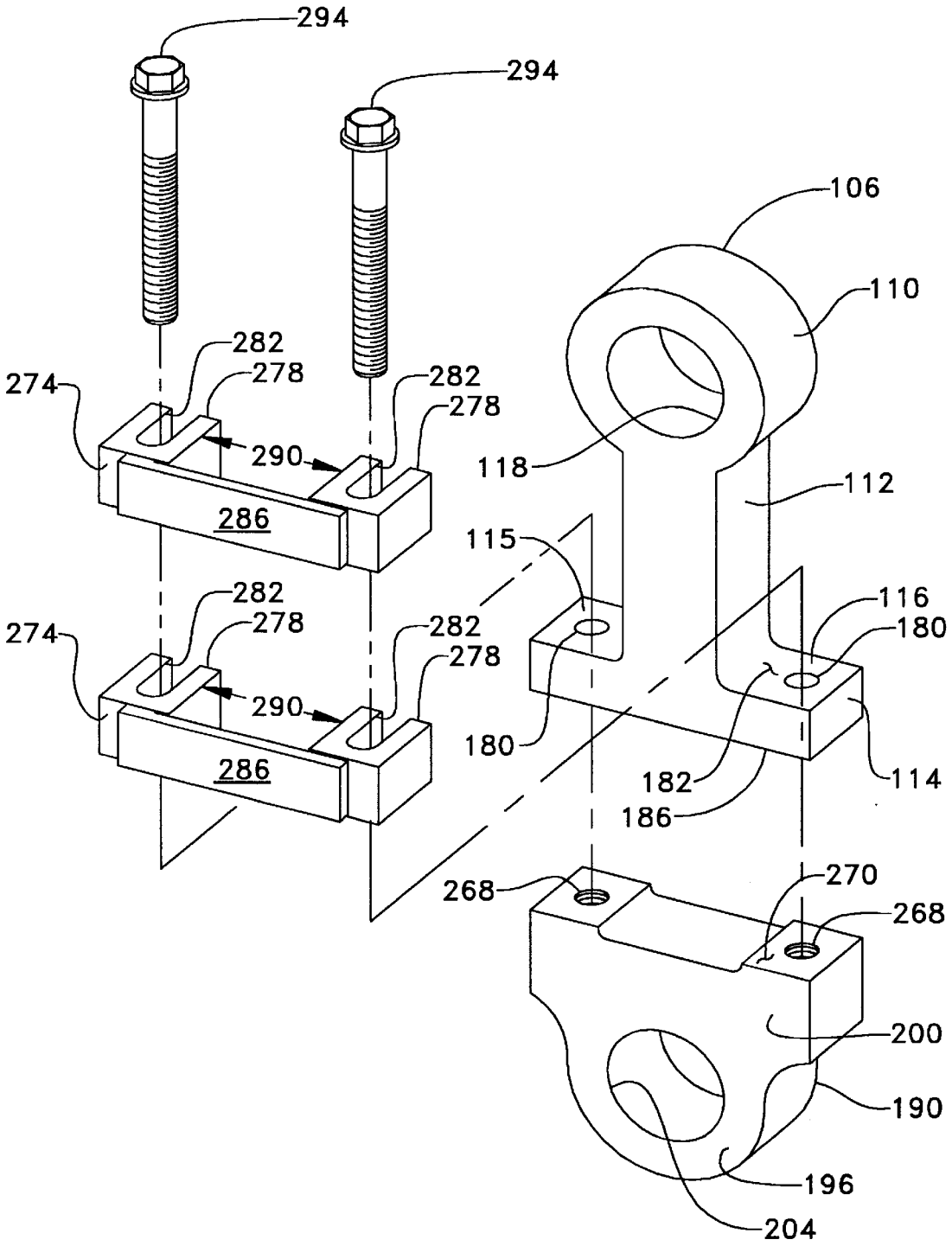
FIG. 2*a* is an exploded view of the present invention connecting the frame tower assembly and blade assembly shown in FIG. 1.
Figure 2B:
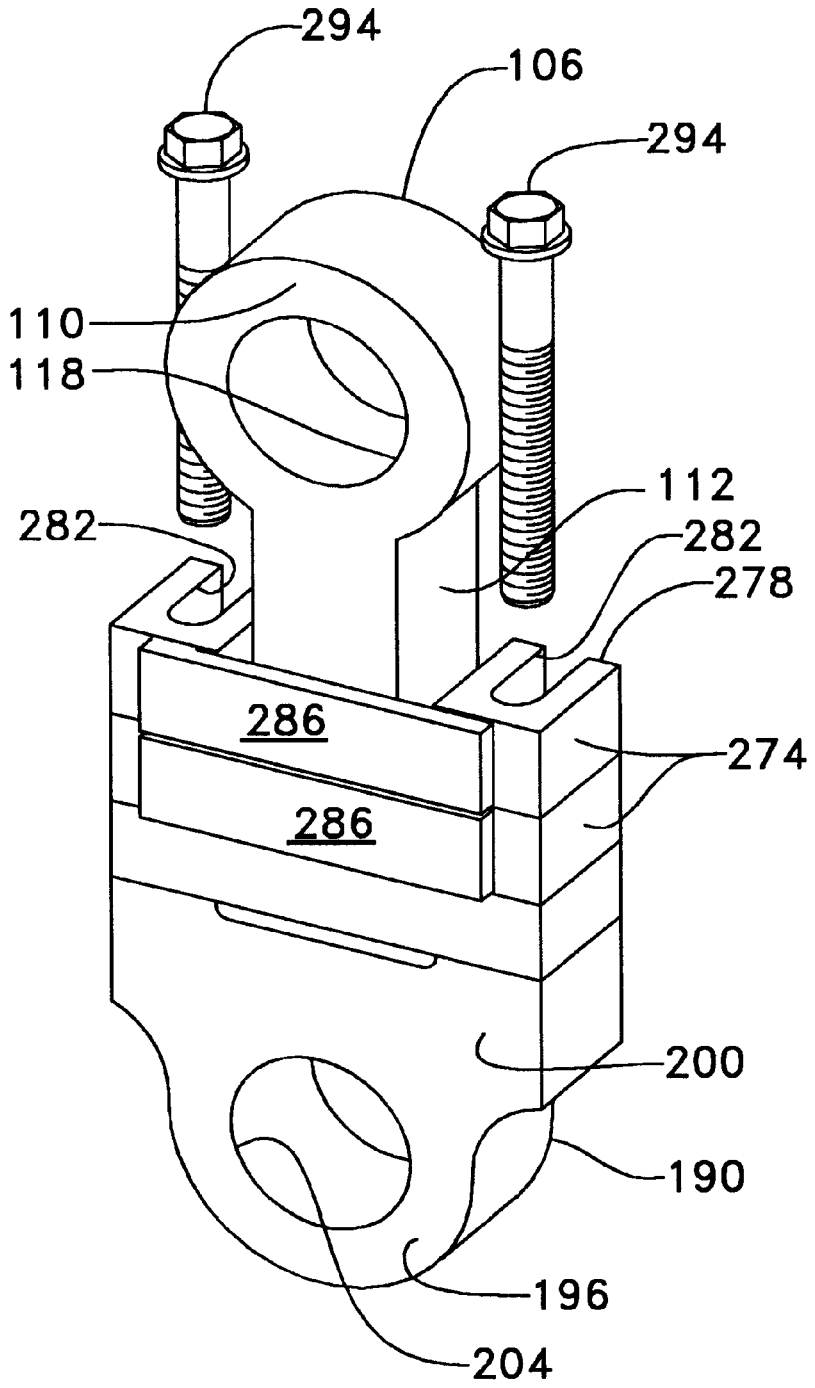
FIG. 2*b* is a perspective view of the present invention partially assembled from the exploded view shown in FIG. 2*a*.
Figure 3:
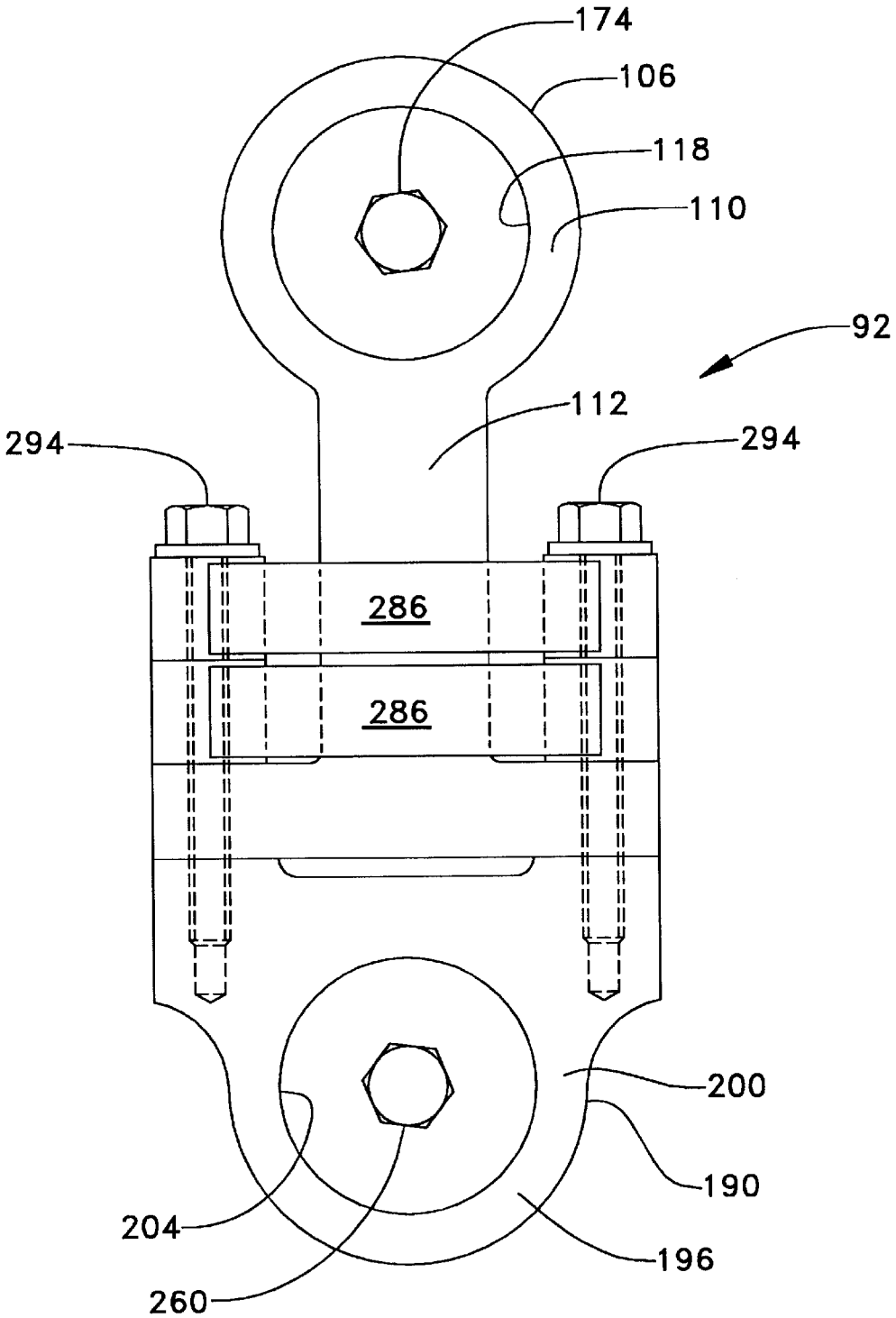
FIG. 3 is a top view of the present invention shown at a first length.
Figure 4:
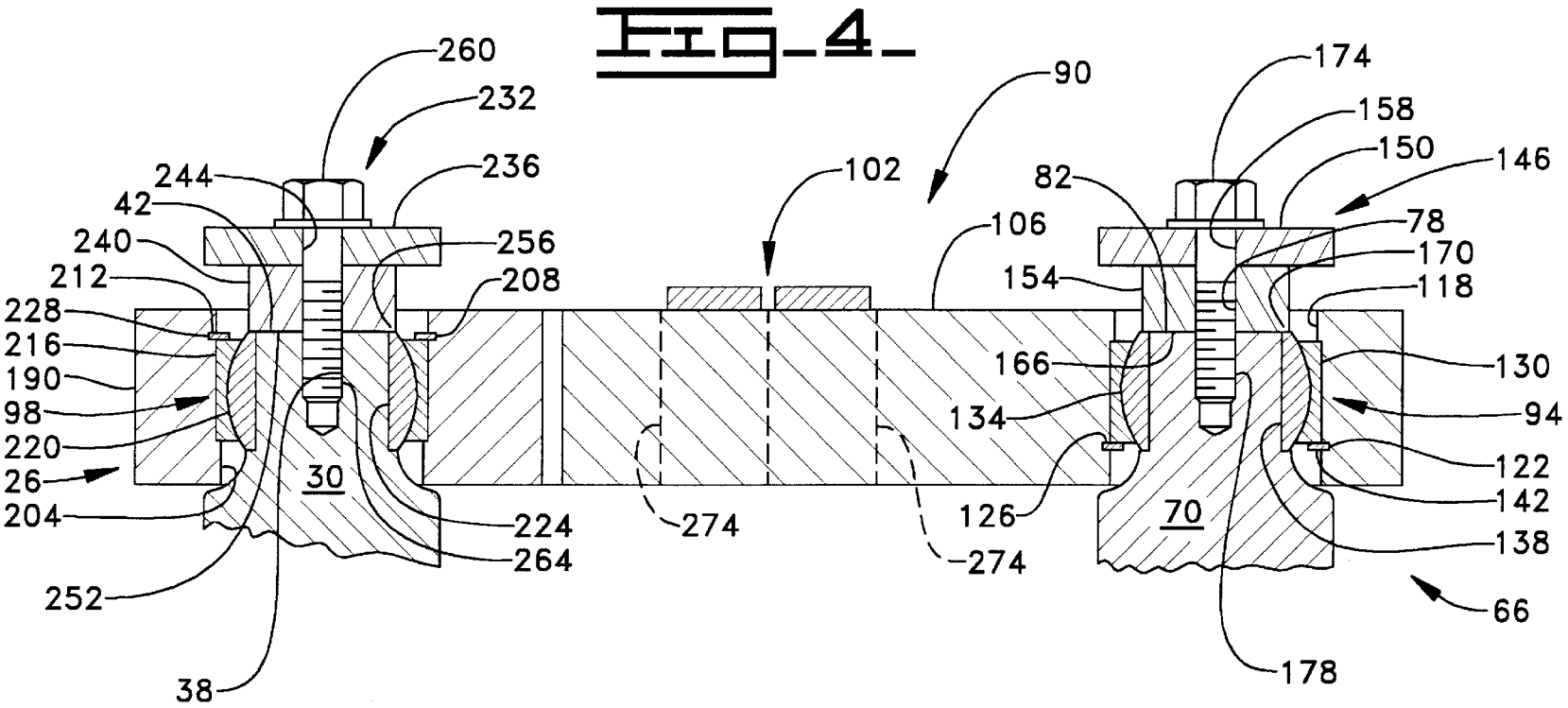
FIG. 4 is a view of the present invention taken along the area encircled by 4—4 on FIG. 1 and partially sectioned.

An adjustable top link assembly 90, seen more clearly in FIGS. 2-4 in a first adjustment position 92, is connected from the blade assembly 46 to the frame assembly 14 at a first joint assembly 94 movably connected to the blade pin 66 and a second joint assembly 98 movably connected to the frame tower pin 26 to define a method 102 for adjusting the pitch angle of the blade assembly 46. An elongated member 106 has a head portion 110 and a neck portion 112 extending from the head portion 110 and terminating at a body portion 114 with a pair of shoulders 115,116. The head portion 110 has a substantially circular shape with a bore 118 extending therethrough. The bore 118 has an annulus 122 therearound which defines a shoulder region 126. The shoulder region 126 is located at a lower portion 130 of the bore 118. A first spherical bearing assembly 134 with an interior bore 138 is pressed within the bore 118 and is held therein by a retaining ring 142 positioned within the annulus 122 in a well known manner. The pin portion 74 of the blade pin 66 is slidably disposed within the interior bore 138 of the first spherical bearing assembly 134. A protective plate assembly 146 including a securing plate 150 and a cover plate 154 each having a coaxially aligned bore 158 therethrough are disposed at the upper surface 82 of the pin portion 74 of the blade pin 66. A bottom surface 166 of the cover plate 154 is adjacent the upper surface 82 and includes a protective portion 170 extending beyond the upper surface 82 to partially cover in a contacting relation a portion of the first spherical bearing assembly 134. A bolt 174 extends through the bores 158 of the securing plate 150 and the cover plate 154 and includes a threaded portion 178 which is threaded into the threaded bore 78 of the pin portion 74 of the blade pin 66 and is tightened to secure the blade pin 66 within the first spherical bearing assembly 134. The body portion 114 of the elongated member 106 has a pair of spaced openings 180 extending through each shoulder 115,116 between an upper and lower surface 182,186, respectively. A block member 190 has a head portion 196 and a body portion 200 extending a predetermined distance from the head portion 196. The head portion 196 has a substantially circular shape with a bore 204 extending therethrough. The bore 204 has an annulus 208 therearound which defines a shoulder region 212. The shoulder region 212 is located at an upper portion 216 of the bore 204. It should be understood that the location of the shoulder regions 126,212 within the bores 118,204 of the elongated and block members 106,190 may be located at any position therealong dependent on the design requirements. A second spherical bearing assembly 220 with an interior bore 224 is pressed within the bore 204 and is held therein by a retaining ring 228 positioned within the annulus 208 in a well known manner. The pin portion 34 of the frame tower pin 26 is slidably disposed within the interior bore 224 of the second spherical bearing assembly 220. A protective plate assembly 232 including a securing plate 236 and a cover plate 240 each having a coaxially aligned bore 244 therethrough are disposed at the upper surface 42 of the pin portion 34 of the frame tower pin 26. A bottom surface 252 of the cover plate 240 is adjacent the upper surface 42 and includes a protective portion 256 extending beyond the upper surface 42 to partially cover in a contacting relation a portion of the second spherical bearing assembly 220. A bolt 260 extends through the bores 244 of the securing plate 236 and the cover plate 240 and includes a threaded portion 264 which is threaded into the threaded bore 38 of the pin portion 34 of the frame tower pin 26 and is tightened to secure the frame tower pin 26 within the second spherical bearing assembly 220. The body portion 200 of the block member 190 has a pair of spaced threaded openings 268 extending from a lower surface 270 thereof a predetermined distance into the body portion 200 with each of the threaded openings 268 substantially coaxially aligned with a respective openings 180 in the elongated member 106. The lower planar surface 270 of the block member 190 is adjacent and substantially co-planar with the lower surface 186 of the elongated member 106.

Means (not shown) for greasing the first and second spherical bearing assemblies is disposed within the head portions 110,196 of the elongated and block members 106, 190. The greasing means (not shown) may be of any suitable type, such as a grease zerk, capable of communicating fluid, such as oil or grease, externally from a source to the first and second bearing assemblies 134,220.

A pair of spacers 274 each include a pair of blocks 278 with a semi-arcuate notch 282 defined therein. The blocks 278 are connected by a plate 286 at one end to define a clearance space 290 therebetween which has a thickness substantially equal to the thickness of the elongated member 106. The notches 282 are substantially coaxially aligned with the threaded openings 180,268 in the elongated and block members 106,190. The pair of spacers 274 are disposed on the upper surface 182 of the body portion 114 in a stacked relationship adjacent one another with the neck portion 112 of the elongated member 106 fitted within the clearance space 290 on each of the pair of spacers 274. It should be understood that although a pair of spacers 274 are shown and described, that one to a plurality of spacers may be used in the design and are within the scope of the present invention. A pair of threaded bolts 294 extend simultaneously through the notches 282 in the spacers 274 and the openings 180 in the elongated member 106 for threading into the openings 268 of the block member 190 to secure the top link assembly 90 at a first predetermined length.

Figure 5:
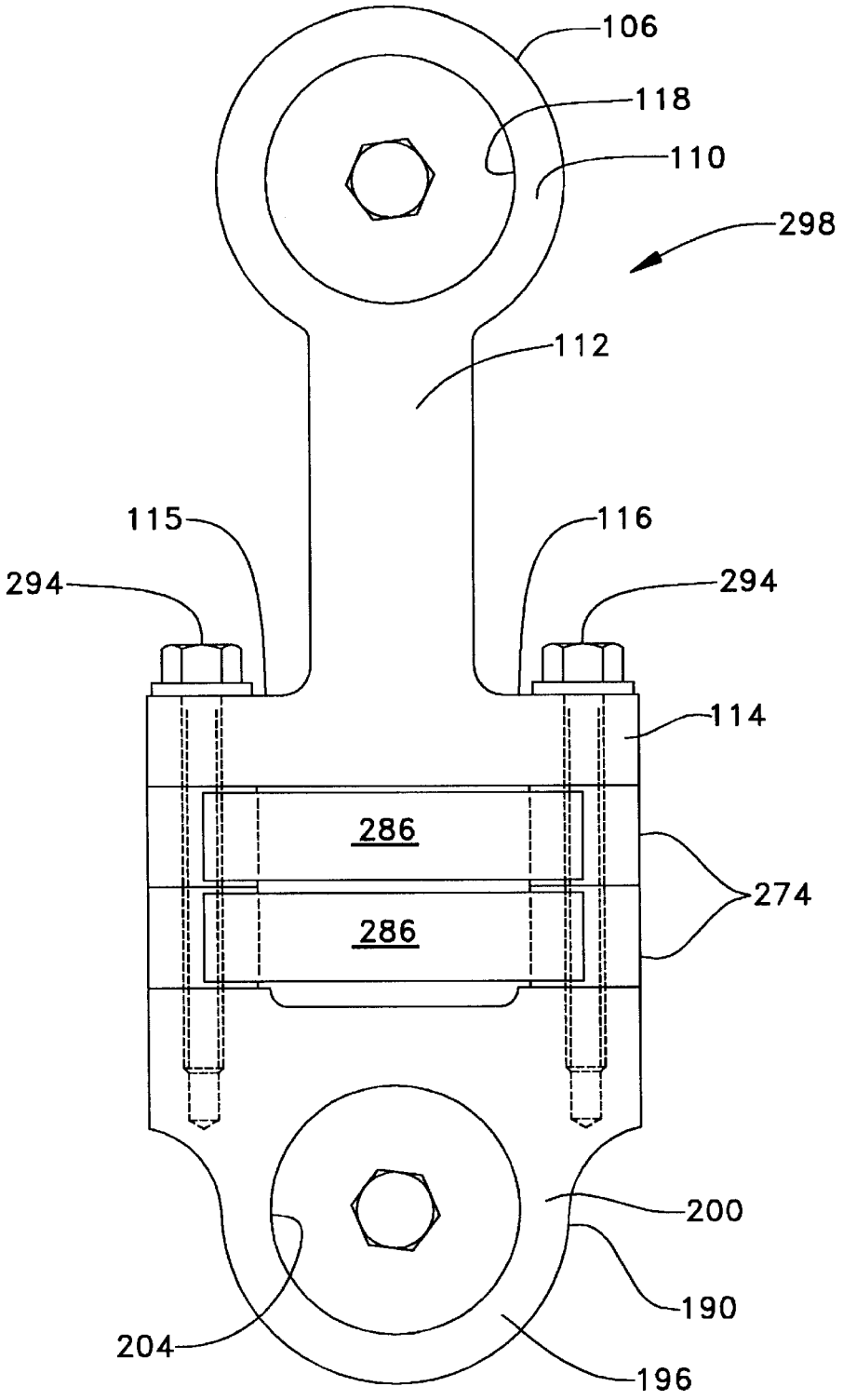
FIG. 5 is a top view of the present invention shown at a second length.

The adjustable top link assembly 90 is shown in a second adjustment position 298 in FIG. 5. It should be understood that the reference numbers used in FIGS. 1–4 will be used to reference similar designated features in FIG. 5. The pair of spacers 274 are disposed adjacent one another between the elongated member 106 and the block member 190 in a stacked relationship. The pair of threaded bolts 294 extend simultaneously through the openings 180 in the elongated member 106 for threading into the openings 268 of the block member 190 and the notches 282 in the spacers 274 to secure the top link assembly 90 at a second predetermined length. It should also be understood that only one of the pair of spacers 274 or a plurality of spacers may be positioned between the elongated member 106 and block member 190 to achieve variable adjustment positions.

Industrial Applicability

Adjustment of the pitch of the cutting edge 54 of the blade portion 50 of the blade assembly 46 is accomplished through the utilization of the adjustable top link assembly 90. The lower portion 58 of the blade assembly 46 is positioned on the ground location GL and the blade assembly is held at the lower portion 58 through the pivot. At the first predetermined length, the spacers 274 are positioned at the upper surface 182 of the body portion 114 of the elongated member 106 and secured in the top link assembly 90 by the pair of bolts 294. The method 102 of adjusting the pitch angle of the blade assembly 46 includes loosening the bolts 294 within a predetermined number of rotations to remove the pair of spacers 274 from the upper surface 182 and to position the pair of spacers 274 between the lower surfaces 186,270 of the elongated member 106 and block member 190. The bolts 294 are tightened to secure the elongated member 106, block member 190 and spacers 274 together at the second predetermined length defined by the thickness of the pair of spacers 274. The positioning of the pair of spacers 274 in such a manner increases the length of the top link assembly 90 and, ultimately, the pitch angle of the blade assembly 46. It should be understood that a plurality of adjustment positions may be defined dependent upon the number and thickness of the spacers used between the elongated member 106 and block member 190. To re-establish the first predetermined length of the top link assembly, the bolts 294 are loosened a predetermined number of rotations and the pair of spacers 274 is removed from between the elongated member 106 and block member 190 and positioned on the upper surface 182 of the body portion 114 of the elongated member 106. The bolts 294 are tightened to secure the elongated member 106, block member 190 and pair of spacers 274 together at the first predetermined length. Extending the length of the top link assembly 90 at an upper portion 60 of the blade 50 and the frame tower 18 while holding the lower portion 58 of the blade 50 enables the pitch angle of the cutting edge 44 of the blade portion 50 to be adjusted. The further the distance of the blade pin 66 from the pivot allows for decreased loading on the top link assembly 90. The top link assembly 90 additionally prevents the blade 50 from pitching randomly at various cutting angles due to the ability to firmly hold the blade 50 at a selected pitch angle during operation. Additionally, the tooling necessary to loosen the bolts 294 is of a standard type which is simple and easy to use. Furthermore, the storage of the adjustment spacers 274 within the top link assembly 90 when at the first predetermined length allows for convenient adjustment to the top link assembly in a quick and efficient manner.

Other aspects, objects and advantages of this invention can be obtained from a study of the drawings, disclosure and the appended claims.

We claim:

1. An adjustable top link assembly for connecting a blade assembly to a frame, comprising:

an elongated member connected by a first joint assembly to the blade assembly, the elongated member having a body portion with upper and lower planar surfaces defining a pair of openings therethrough;

a block member connected by a second joint assembly to the frame, the block member having a lower planar surface adjacent and substantially co-planar with the lower surface of the body portion of the elongated member with a defined pair of threaded openings extending a predetermined distance therein substantially co-axial with the pair of openings in the elongated member;

a pair of fastener mechanisms extending simultaneously through the openings in the elongated member and threaded into the block member to secure the elongated member and block member together to define a first predetermined length of the top link assembly; and at least one spacer secured by the pair of fastener mechanisms at a first position in the top link assembly for maintaining the first predetermined length thereof and secured at a second position in the top link assembly for defining a second predetermined length thereof.

2. The adjustable top link assembly of claim 1, wherein the first position of the at least one spacer includes disposing the at least one spacer on the upper surface of the elongated member with a pair of semi-arcuate notches defined therein substantially co-axially aligned with the openings in the elongated member and block member, each one of the pair of notches partially surrounding a respective fastener mechanism.

3. The adjustable top link assembly of claim 1, wherein the second position of the at least one spacer includes disposing the at least one spacer between the elongated member and the block member with each one of the pair of notches partially surrounding a respective fastener mechanism.

4. An adjustable top link assembly for connecting a blade assembly to a frame, comprising:

an elongated member connected by a first joint assembly to the blade assembly, the elongated member having a body portion with upper and lower planar surfaces defining a pair of openings therethrough;

a block member connected by a second joint assembly to the frame, the block member having a lower planar surface adjacent and substantially co-planar with the lower surface of the body portion of the elongated member with a defined pair of threaded openings extending a predetermined distance therein substantially co-axial with the pair of openings in the elongated member;

a pair of fastener mechanisms extending simultaneously through the openings in the elongated member and threaded into the block member to secure the elongated member and block member together to define a first predetermined length of the top link assembly; and means for adjusting the length of the top link assembly without removal of the pair of fastener mechanisms.

5. The adjustable top link assembly of claim 4, including at least one spacer adapted for insertion between the elongated member and the block member when the pair of fasteners are loosened and adapted to define a second predetermined length of the top link assembly when the pair of fastener mechanisms are tightened and the at least one spacer is secured therein.

6. The adjustable top link assembly of claim 5, wherein the at least one spacer is adapted for removal from between the elongated member and the block member when the pair of fasteners are loosened and adapted for insertion on the upper surface of the elongated member to achieve the first predetermined length of the top link assembly when the pair of fastener mechanisms are tightened and the at least one spacer is secured therein.

7. A method for adjusting the pitch angle of a blade assembly for a construction machine having a frame, comprising the steps of:

connecting a elongated member through a first joint assembly to the blade assembly, the elongated member having a body portion with upper and lower planar surfaces defining a pair of openings therethrough;

connecting a block member through a second joint assembly to the frame, the block member having a lower planar surface and defining a pair of threaded openings which extend a predetermined distance therein from the lower planar surface;

positioning the lower planar surface of the block member adjacent the lower planar surface the elongated member and substantially co-planar therewith so that the respective pair of openings are substantially co-axially aligned;

extending a threaded fastener through each of the openings in the elongated member for threading into the block member to secure the elongated member and block member together to define a top link assembly having a first predetermined length;

loosening the threaded fastener within a predetermined number of rotations to position at least one spacer having a pair of semi-arcuate notched portions between the elongated member and block member of the top link assembly by sliding the semi-arcuate notched end portions thereof about the threaded fasteners; and tightening the threaded fasteners to secure the elongated member, block member and at least one spacer together to define a second predetermined length of the top link assembly.

8. The method of adjusting the pitch angle of a blade assembly of claim 7, including the steps of:

loosening the threaded fasteners within a predetermined number of rotations to remove the at least one spacer by sliding the semi-arcuate notched end portions thereof away from the threaded fasteners; and moving the at least one spacer from between the elongated member and block member and positioning the at least one spacer adjacent the upper surface of the elongated member by sliding the semi-arcuate notched end portions thereof about the threaded fasteners to re-establish the first predetermined length of the top link assembly.

* * * * *